United States Patent [19]

Oda et al.

[11] 4,211,067

[45] Jul. 8, 1980

[54] TIME ADJUSTING DEVICE FOR ELECTRONIC TIMEPIECE

[75] Inventors: Hajime Oda; Toshihide Samejima; Toshio Matsumura; Nakanobu Moritani; Masanori Fujita, all of Tokyo, Japan

[73] Assignee: Kabushiki Kaisha Seikosha, Tokyo, Japan

[21] Appl. No.: 898,770

[22] Filed: Apr. 21, 1978

[30] Foreign Application Priority Data

Apr. 22, 1977 [JP] Japan ..... 52/46389

[51] Int. Cl.[2] ..... G04B 27/00

[52] U.S. Cl. ..... 368/185; 368/82; 368/200

[58] Field of Search ..... 58/23 R, 85.5, 50 R

[56] References Cited

U.S. PATENT DOCUMENTS

| | | | |
|---|---|---|---|
| 3,733,810 | 5/1973 | Girard | 58/85.5 X |
| 3,871,168 | 3/1975 | Maire et al. | 58/85.5 |
| 3,928,959 | 12/1975 | Naito | 58/23 R |
| 4,023,343 | 5/1977 | Martinet | 58/85.5 X |
| 4,091,612 | 5/1978 | Meisner et al. | 58/85.5 |
| 4,107,915 | 8/1978 | Sekiya et al. | 58/23 R |

*Primary Examiner*—Ulysses Weldon

*Attorney, Agent, or Firm*—Robert E. Burns; Emmanuel J. Lobato; Bruce L. Adams

[57] ABSTRACT

A time adjusting device for an electronic timepiece utilizes a manually rotatable mechanism which generates pulses corresponding in frequency and number with the speed and extent of rotation thereof. Each pulse which is generated is thereafter converted into a plurality of pulses. A manually actuatable switch applies either the normal periodic time pulses to a time counter or the plurality of pulses to the time counter upon actuation to adjust the time count therein.

8 Claims, 8 Drawing Figures

TIME ADJUSTING DEVICE FOR ELECTRONIC TIMEPIECE

BACKGROUND OF THE INVENTION

This invention relates to a time adjusting device for electronic timepieces and more particularly to a mechanism for making time adjustment in electronic timepieces by converting each output pulse generated with the operation of a manual operating switch means into plural adjusting pulses.

Time correcting devices in conventional electronic digital timepieces are mostly of the push-button systems including several different types of mechanisms such as the type in which the counting value of a counter is advanced by one pushbutton with a single push, a type in which quick advancement is made at a constant speed while the push-button is kept depressed and a type using a combination of the two aforesaid mechanisms. The first type, however, is troublesome in operation as it involves the necessity of pressing the push-button as many as 59 times at most for correcting the minute's place, while the second has the disadvantage of requiring the user is required to keep pressing the switch for as long as 59 seconds for making the desired correction of the minute's place in the case where the correcting mechanism is designed to operate with a period of one second. When the correcting speed is increased to avoid this, the display often passes the object time since it operates so fast.

SUMMARY OF THE INVENTION

The first object of this invention, therefore, is to provide a novel time adjusting device which is capable of quickly effecting any desired time adjustment in an electronic timepiece.

The second object of this invention is to provide a time adjusting device having manual operating switch means for time adjustment wherein each output pulse from the manual operating switch means is converted into plural pulses so as to allow an increase of the time adjusting speed for the electronic timepiece with no need for too high an operating speed for the manual operating switch means.

The third object of this invention is to provide a time adjusting device which can be suitably adapted in a small-sized electronic timepiece by making it possible to effect high-speed time adjustment by the low-speed operation of a manual operating switch means to allow adaptation of a small-sized manual operating switch means with a minimized number of contacts.

The fourth object of this invention is to provide a time adjusting device with an additional degree of freedom for correction, featuring an improved arrangement in which the manual operating switch means is axially movable and the adjusting pulse number corresponding to a predetermined operating speed of the manual operating switch means is properly changed at each position of movement to allow suitable selection of adjusting pulses of the desired period.

BRIEF DESCRIPTION OF THE DRAWINGS

The nature of the present invention as well as other objects and advantages thereof will become more apparent from consideration of the following detailed description and the accompanying drawings in which.

PREFERRED EMBODIMENTS OF THE INVENTION

Figure 1:
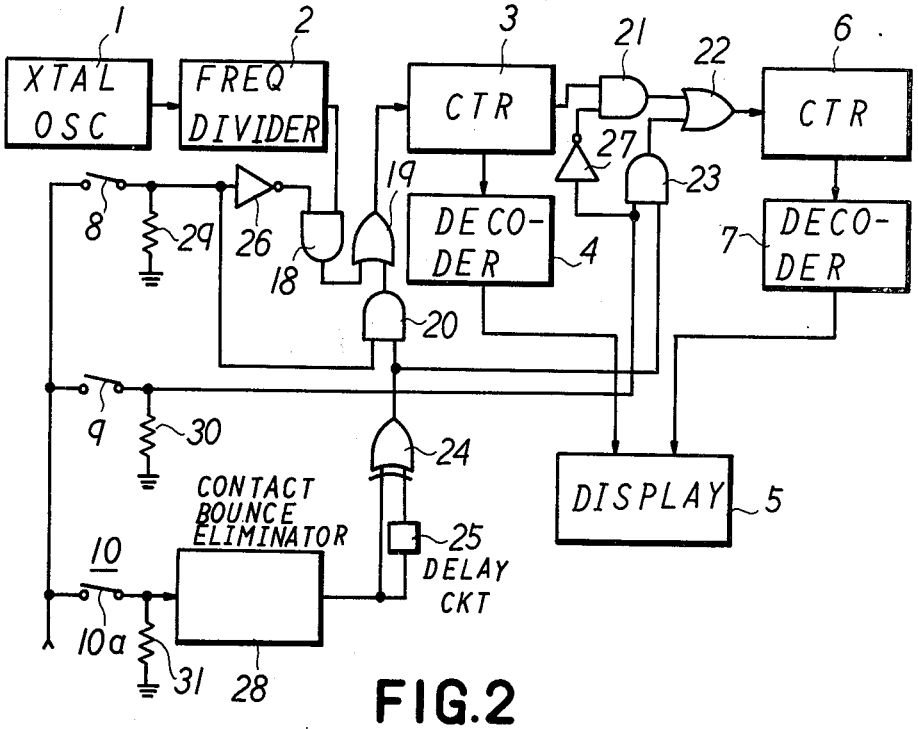
FIG. 1 is an electric circuit block diagram of an embodiment of this invention.

Referring to FIG. 1, the output frequency of a crystal oscillator 1 is divided to 1 Hz in a frequency divider 2. The counter 3 counts minutes and its output is converted into a signal suitable for display by a decoder 4 and its content is displayed by a display 5. Another counter 6 counts hours and its output is converted into a signal suitable for display by a decoder 7 and displayed as the hour time by the display 5. Manual switches 8, 9 are adapted to select the counters 3, 6, respectively, to allow the divider 2 to supply pulses thereto. A switch 10*a* is formed from a manual rotary switch mechanism 10 shown in FIGS. 2 and 3. The manual rotary switch mechanism 10 comprises a knob 11 secured to one end of electroconductive shaft 12, a rotatory disc 13 also secured to the shaft 12, the disc 13 being made of an electrically insulating material and having formed on one side a plurality of segment electrodes 14, which are electrically connected to the shaft 12 through a common electrode 15, a conductor piece 16 provided in contact with the shaft 12 and connected to a power source (see FIG. 1) through a terminal P1, and a contact element 17 having one end 17*a* elastically pressed against the segment electrodes 14 and grounded at the other end through a terminal P2 and a resistor 31 (see FIG. 1). Again referring to FIG. 1, reference numerals 18 to 23 denote gate circuits, 24 is an exclusive "or" gate circuit, 25 is a time delay circuit with a short time delay, 26 and 27 are inverters, 28 is a contact bounce eliminator, and 29 to 31 are resistors.

The operation of the above-described mechanism of this invention will now be explained.

Under normal conditions, both switches 8 and 9 in FIG. 1 are kept open. Under these conditions, each output of inverters 26 and 27 is maintained at a logic value "1" and the gate circuits 18 and 21 are enabled. Therefore, each pulse from the frequency divider 2 is supplied to the counter 3 through gate circuits 18, 19 and minutes are counted. Moreover, the output pulse from the counter 3 is supplied to the counter 6 through the gate circuits 21, 22 to count hours.

Figure 2:
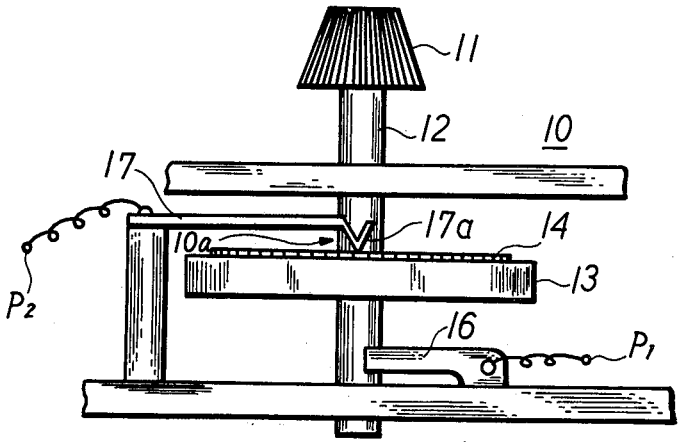
FIG. 2 is a side view of a manual rotary switch used in the embodiment of FIG. 1.
Figure 3:
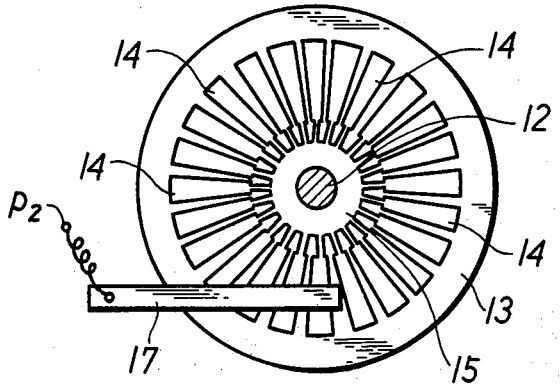
FIG. 3 is a plan view showing a part of the switch mechanism of FIG. 2.
Figure 4:
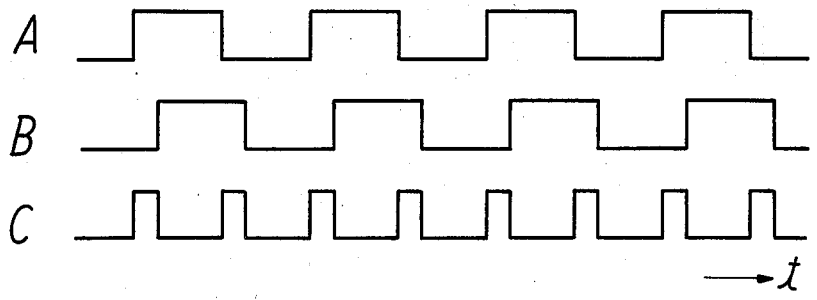
FIG. 4 is a pulse time chart for illustrating the operation of the above embodiment of FIG. 1 of the invention.

When it is desired to make an adjustment of the minute count, the switch 8 is first closed to accordingly free the output of gate circuit 18 to 0 while enabling the gate circuit 20. Then the knob 11 of FIG. 2 is turned to cause corresponding rotation of the rotatory disc 13 to let the end portion 17*a* of the contact element 17 successively contact the segment electrodes 14. By this operation, the switch 10 of FIG. 1 is opened and closed. Consequently, a pulse signal having the wave form A in FIG. 4 is generated from the contact bounce eliminator 28 and supplied to the gate circuit 24. Additionally, the pulse signal is delayed by the delay circuit 25 to obtain waveform B in FIG. 4 and supplied to the gate circuit 24. Accordingly, at both the leading and trailing edges of each pulse signal from the contact bounce eliminator 28, there is produced from the gate circuit 24 a pulse having a width corresponding to the delay time in the delay circuit 25, as shown by waveform C in FIG. 4. This pulse is supplied to the counter 3 through the gate circuits 20, 19 to make an adjustment of the minute count.

For making an adjustment of the hour count, the switch 9 is closed and then the knob 11 of FIG. 2 is turned, whereby the completely identical operation as described above is performed to effect the desired hour adjustment.

Thus, there are generated from the gate circuit 24 twice the number of pulses as the number of times of contact and separation between the contact element 17 and the electrodes 14.

Figure 5:
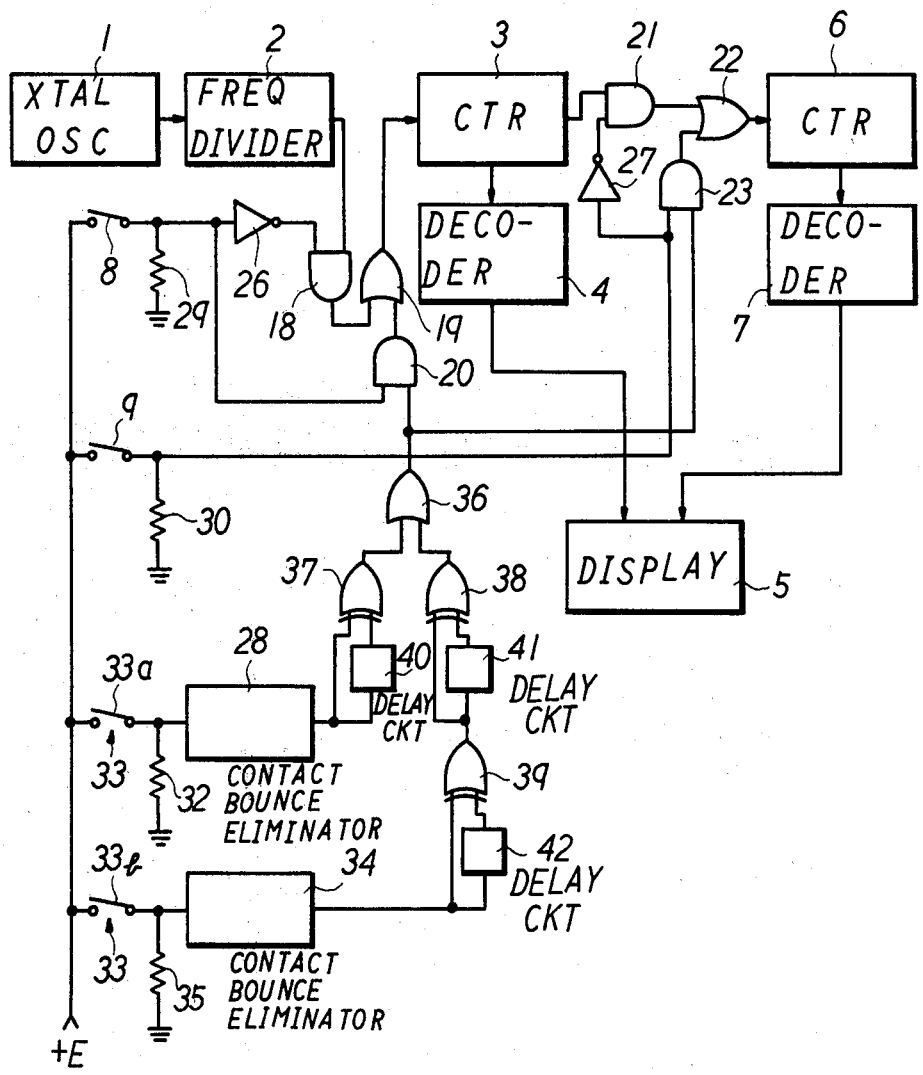
FIG. 5 is an electric circuit block diagram of another embodiment of this invention.
Figure 6:
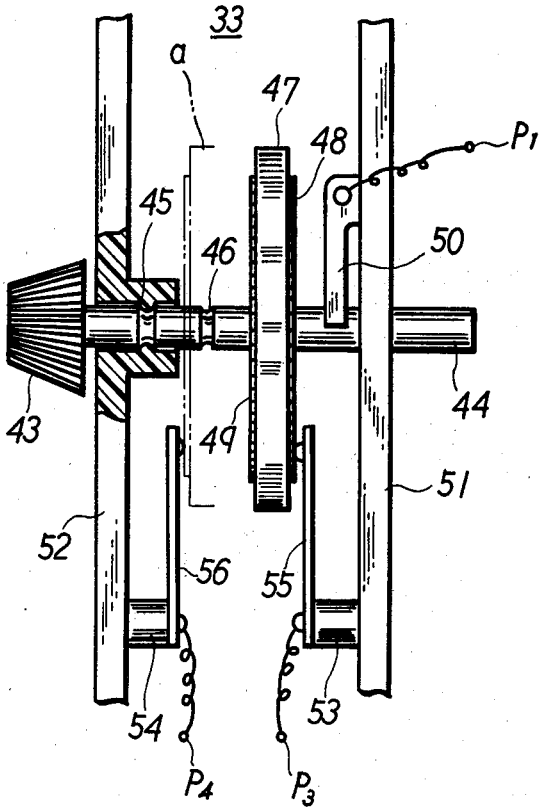
FIG. 6 is a side view, with parts cut away, of a manual rotary switch used in the embodiment of FIG. 5.

Referring now to FIGS. 5 and 6, there is shown another embodiment of this invention. In FIG. 5, reference numeral 34 denotes a contact bounce eliminator 32 and 35 are resistors 36 to 39 are gate circuits and 40 to 42 are delay circuits of a short time duration. The numbers which are the same as used in FIG. 1 indicate identical elements. Both of the switches 33*a* and 33*b* in FIG. 5 are part of the switch mechanism 33 shown in FIG. 6. This switch mechanism 33 comprises a knob 43 secured to one end of an electroconductive shaft 44 which is formed with "click" grooves 45, 46, and a rotatory disc 47 secured to the middle part of the shaft 44. The disc 47 is made of an insulating material and having formed on both sides a plurality of segment electrodes 48, 49 which are electrically connected to shaft 44 through a common electrode (not shown) like as in the embodiment of FIG. 3. A conductive piece 50 contacted at one end with the shaft 44 is connected at the other end to the power source E (see FIG. 5) through a terminal P1, a pair of support plates 51, 52 have fixed thereon, in opposed relation, the columnar members 53, 54, and a pair of contact elements 55, 56 are secured at one end to the respective columnar members 53, 54 and positioned such that the other ends are able to contact the segment electrodes 48, 49. Terminals P3, P4, extending out from the respective contact elements 55, 56, are grounded through resistors 32, 35 (see FIG. 5).

In making an adjustment of the minute count in this embodiment, in the case where the span of time to be adjusted is wide, the switch 8 in FIG. 5 is closed and the knob 43 in FIG. 6 is pulled to bring the disc 47 to the position a where the contact element 56 can contact the segment electrodes 49, and then the knob 43 is turned to let the contact element 56 successively contact and separate from the segment electrodes 49 to thereby close and open the switch 33*b* in FIG. 5. Consequently, a pulse signal is issued from the contact bounce eliminator 34 and the pulses twice as many in number as in the pulse signal are generated from the gate circuit 39 as explained heretobefore, and there are further produced from gate circuit 38 pulses which are twice as many in number as the aforesaid pulses from the gate circuit 39. These pulses are supplied to the counter 3 through the gate circuits 36, 20, 19 to adjust the counter contents. When the count value of the counter 3 has approached the desired count, the knob 43 is pushed in and then turned, whereby the contact element 53 is now successively contacted and separated from the electrodes 48 to open and close the switch 33*a* in FIG. 5 to produce a pulse signal from the contact bounce eliminator 28. There is produced from the gate circuit 37 a pulse signal which is twice as many in number as the number of pulse signals from circuit 28, and this pulse signal is supplied to the counter 3 through the gate circuits 36, 20, 19, whereby the counter 3 is controlled to advance at half the speed of the previous operation, allowing the user to make adjustment with prudence so that the counter indication won't pass the desired adjusted time count.

Adjustment of the hour count can be effected in a similar way by first closing the switch 9 instead of switch 8.

Thus, in this embodiment, the speed of counter advancement can be controlled by the axial movement of the rotatory member, so that when the extent of adjustment to be made is large, advancement is effected at relatively high speed and when the counter indication has approached the time to be adjusted, the speed of advancement is slowed down to allow accurate adjustment.

Figure 7:
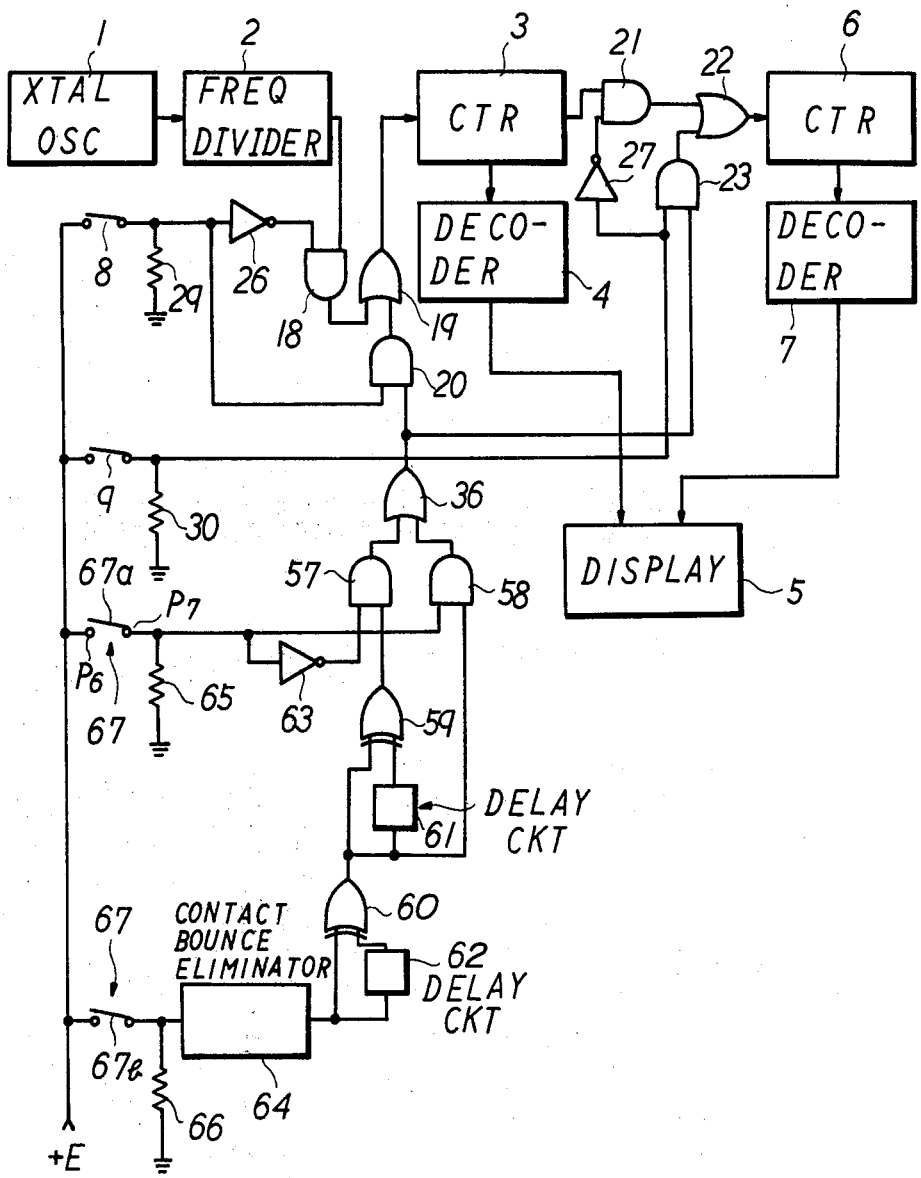
FIG. 7 is an electric circuit block diagram of still another embodiment of the invention.
Figure 8:
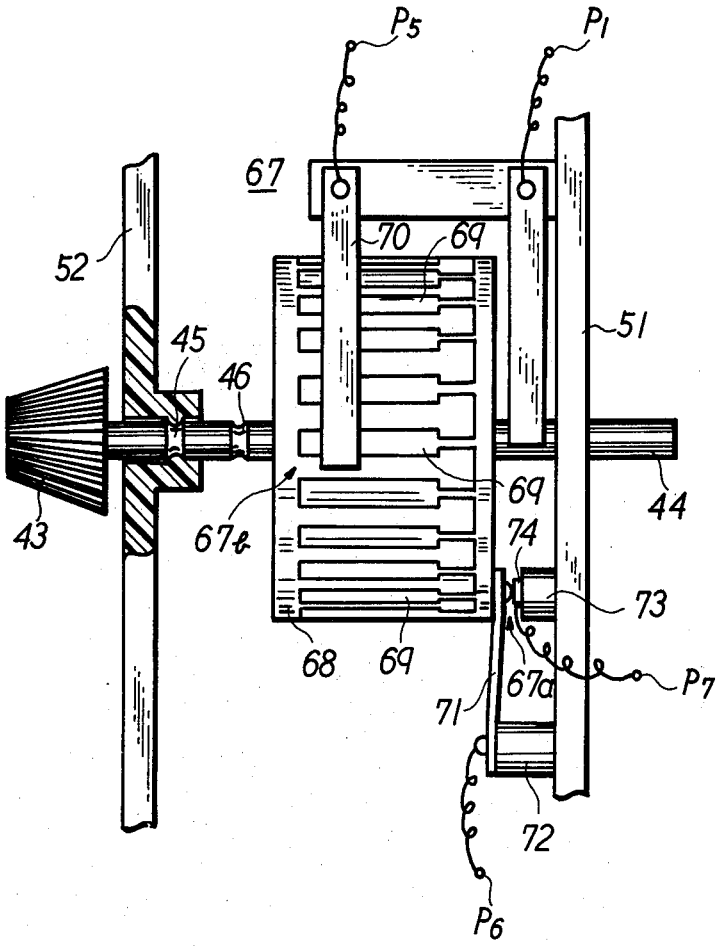
FIG. 8 is a side view, with parts cut away, of a manual rotary switch used in the embodiment of FIG. 7.

Still another embodiment of this invention is illustrated in FIGS. 7 and 8. In these figures, reference numerals 57 to 60 indicate gate circuits, 61 and 62 are delay circuits, 63 is an inverter 64 is a contact bounce eliminator and 65 and 66: are resistors. Switches 67a and 67b are formed by the mechanism 67 shown in detail in FIG. 8. As shown, a plurality of segment electrodes 69 are formed along the periphery of a drum-shaped rotatory member 68, and a contact element 70 is provided so that it is able to successively contact and separate from these electrodes. The contact element 70 is grounded through a terminal P5 and a resistor 66 (see FIG. 7). Another contact element 71 is secured at one end to a columnar member 72 fixed on a support plate 51 while the other end of the contact element 71 is arranged so as to be able to contact the contact point 74 on another columnar member 73 also fixed on the support plate 51. The terminal P6 of the contact element 71 is connected to power E while the terminal P7 at the other end thereof is grounded through a resistor 65 (see FIG. 7). In these figures, the same numbers as used in the preceding figures indicate corresponding elements.

In the case of making a minute adjustment in this embodiment, if the extent of the adjustment is large, the switch 8 is closed and the knob 43 in FIG. 8 is pulled in and then turned, whereby the switch 67*a* is open and the gate circuit 57 is enabled by the output of the inverter 63, and accordingly, four times as many pulses as the number of times that of the contact element 70 and segment electrodes 69 contact and separate are generated from the gate circuit 59 and supplied to the counter 3 through the gate circuits 57, 36, 20, 19. When the desired time to be adjusted to has been approached, the knob 43 is now pushed in and then turned, whereby the switch 67*a* is closed while the gate circuits 57 and 58 are disenabled and enabled, respectively. As a result, there are generated from the gate circuit 60 twice as many as the number of times the contact element 70 and segment electrodes 69 contact and separate, and these pulses are supplied to the counter 3 through the gate circuits 58, 36, 20, 19. Thus, counter advancement is made at half the speed of the preceding operation to allow precise adjustment with little possibility of causing excess advancement.

In the embodiments of FIGS. 5 and 7, 2 pulses and 4 pulses are selectively supplied to the counter for one contact-and-separation of the contact element and segment electrodes, but it is possible to decrease the combinations of the delay circuits and gate circuits having the exclusive or function so that 1 pulse and 2 pulses will be selectively supplied to the counter. If the combinations of the gate and delay circuits are increased in number, a greater number of pulse signals can be produced. This allows a decrease in the number of the segment electrodes and hence miniaturization of the rotatory member.

Also, in the above embodiments, the multiplied numbers of pulses are generated by the combinations of the delay circuits and the gate circuits having the exclusive "or" function, but use of other means is also possible within the scope of this invention. For example, both leading and trailing edges of the pulse signal may be differentiated so as to effect advancement of the counter indication by means of both differential outputs.

Further, in the foregoing embodiments, an arrangement is used in which each pulse signal is generated by contact and separation of a contact element and a plurality of segment electrodes, but other arrangements are also possible in this invention. For instance, a plurality of holes may be provided along the circumference of a rotatory disc, and a luminous element and a receptor element may be provided at a location on the circumference in opposed relation to each other with the disc being sandwiched therebetween. It is also possible to arrange a plurality of magnets along the circumference of a disc while providing a magneto-sensitive element at a location corresponding to the circumference.

A pressure-sensitive element may also be used. In this case, a plurality of hemispherical protuberances are provided along the circumference of a disc member, and a semi-circular press member, a spring pressed by the press member and a pressure-sensitive element adapted to receive the pressing force of the spring are arranged at a location in opposed relation to the circumference. Also, in the embodiments of FIGS. 6 and 8, a mechanism is employed in which the number of pulses produced by the rotating movement of a rotatory member through a predetermined angular distance is changed in accordance with the axial movement of the rotatory member, but this mechanism is not essential, since it is also possible to adapt a manual switch means to effect the change of pulse number by the make and break output thereof.

Thus, according to the present invention, each pulse signal produced in accordance with rotation of a manual rotary switch is converted into a plurality of working pulse signals, so that it is possible to produce many pulse signals without increasing the manual switch operating speed and the counter indication can be corrected quickly at any desired speed. Therefore, if an arrangement is employed in which each pulse signal is produced by the contact and separation of a contact element with a plurality of segment electrodes provided on a rotatory member as in the described embodiments, the number of the segment electrodes can be minimized to allow miniaturization of the rotatory member. This mechanism therefore proves most useful for time adjustment in a small-sized electronic timepiece.

Also, if an arrangement is employed in which the rotatory member is movable axially and the frequency of occurence of pulse signals is made different from one position of movement to the other, it is possible to switch the number of pulse signals produced by rotation of the rotatory member through a predetermined angular distance, allowing suitable selection of the frequency of occurrence of pulse signals by controlling the rotating speed and movement of the rotatory member. This makes it possible to effect any desired time correction in an electronic timepiece quickly and precisely with little possibility of excess advancement of the counter indication.

What is claimed is:

1. Time adjusting device for an electronic timepiece comprising: first means adapted to rotate in accordance with a manual operation; second means for generating pulses corresponding in frequency and number with the speed and extent of rotation of said first means; third means for converting each pulse from said second means into a plurality of pulses; fourth means for generating periodic time pulses; time counting means for counting time in response to the receipt of pulses; manually actuatable fifth means for normally applying the periodic pulses to said time counting means and for applying the plurality of pulses from said third means to the counting means upon actuation to adjust the time count therein.

2. Time adjusting device for an electronic timepiece as claimed in claim 1, wherein the first means is a rotatory member rotatable about a shaft.

3. Time adjusting device for an electronic timepiece as claimed in claim 2, wherein the second means comprises a plurality of segment electrodes arranged on the rotatory member and at least one contact element adapted to contact with and separate from said segment electrodes.

4. Time adjusting device for an electronic timepiece comprising: first means mounted for rotation about an axis and axial movement therealong between at least two positions; second means for generating pulses corresponding in frequency and number with the speed and extent of rotation of said first means; third means for converting each pulse from said second means into a plurality of pulses and at least one multiple of the plurality of pulses; switching means controlled by the axial movement of said first means for alternatively applying the plurality of pulses and the multiple thereof to a first terminal; fourth means for generating periodic time pulses; time counting means for counting time in response to receipt of pulses; and manually actuatable fifth means for normally applying the periodic pulses to said time counting means and for applying the plurality of pulses or the multiple thereof at the first terminal to the counting means upon actuation to adjust the time count therein.

5. Time adjusting device for an electronic timepiece as claimed in claim 4 wherein the first means comprises a shaft provided with click recessions.

6. Time adjusting device according to claim 5, wherein the second means comprises a rotatory member fixed to the shaft and axially movable therewith.

7. Time adjusting means according to claim 6, wherein the rotatory member is a disc, and the second means further comprises a plurality of segment electrodes on each face of the disc and two contact elements, one contact element disposed to contact one plurality of segement electrodes when the shaft is in one axial position and the other contact element disposed to contact the other plurality of segment electrodes when the shaft is in a second axial position.

8. Time adjusting means according to claim 6, wherein the rotatory member is a drum member, and the second means further comprises a plurality of segment electrodes on the circumferential edge thereof and a contact element in contact therewith independent of the axial position of the shaft.

* * * * *